United States Patent [19]

Duba

[11] 3,977,451

[45] Aug. 31, 1976

[54] GOLF BAG HOOD RAIN COVER

[76] Inventor: Eugene B. Duba, 5000 S. Second St., Louisville, Ky. 40202

[22] Filed: Nov. 20, 1974

[21] Appl. No.: 525,639

[52] U.S. Cl. ..... 150/1.5 R; 150/7; 150/52 R; 150/52 G

[51] Int. Cl.[2] ..... A63B 55/00

[58] Field of Search ..... 150/1.5 R, 1.5 B, 1.5 C, 150/52 R, 52 E, 7, 52 G

[56] References Cited

UNITED STATES PATENTS

| | | | |
|---|---|---|---|
| 1,040,300 | 10/1912 | Fitzgerald | 150/52 R |
| 2,256,521 | 9/1941 | Kirkpatrick et al. | 150/1.5 R |
| 2,471,169 | 5/1949 | Salzberg et al. | 150/52 G |
| 2,917,094 | 12/1959 | Sullivan | 150/52 R |
| 3,143,154 | 8/1964 | Best | 150/52 R |
| 3,203,551 | 8/1965 | Loan, Jr. | 150/7 |
| 3,255,794 | 6/1966 | Morse | 150/52 G |
| 3,557,853 | 1/1971 | Jones | 150/7 |

FOREIGN PATENTS OR APPLICATIONS

| | | | |
|---|---|---|---|
| 1,230,580 | 5/1971 | United Kingdom | 150/1.5 R |
| 258,421 | 9/1926 | United Kingdom | 150/1.5 |

*Primary Examiner*—William T. Dixson, Jr.
*Assistant Examiner*—Allan N. Shoap
*Attorney, Agent, or Firm*—Edward M. Steutermann

[57] ABSTRACT

The invention provides a cover which can be used in connection with a golf bag having a hood which includes an opening with fastener means where the hood can be secured to the bag, where the fastener means can be closed or can selectively be opened to allow access to the clubs contained within the bag, where the cover attachment provided by the present invention provides a means to loosely cover the opening provided by the golf bag hood when the hood fastener means are released. The cover includes a cap section to be received over the top of the golf bag hood, fastener means to fasten the cover to the hood at the top of the hood with flap means extending downwardly from the cap means to lay across the opening provided by the hood means and where a portion of the flap means can be releasably attached to the golf bag or the hood.

3 Claims, 3 Drawing Figures

GOLF BAG HOOD RAIN COVER

BACKGROUND OF THE INVENTION

In better golf bags it has been conventional for many years to provide a hood which fastened around the mouth of the golf bag. Such covers usually provide an opening and a cooperative fastener means to close the cover to protect the clubs carried in the bag, where the fastener can be released to provide access to the clubs. When the fastener is released the cover only provides a limited degree of protection for the ends of the golf clubs extending out of the bag. Such hoods are usually releasably attached to the bag so that the hood can be removed when it is not necessary to cover the clubs. In one arrangement, as shown in U.S. Pat. No. 2,552,501, and U.S. Pat. No. 2,591,217, have provided openings, usually zippers on the hood. While the hood is retained on the bag when it is in use the opening provided in the hood permits rain to fall into the bag and wet the clubs, while the bag is in use, in the rain. Generally, the hood fastener is not closed while the bag is in use during a rainstorm, because it is cumbersome and awkward for the person using the golf bag to open and close the hood every time a club is to be withdrawn.

Another arrangement as shown in U.S. Pat. No. 2,704,563, provides a full cover for the bag opening which is removed, replaced every time a club is withdrawn or replaced in the bag. Such arrangements are equally cumbersome.

SUMMARY OF THE INVENTION

The present invention provides an advantageous, inexpensive, and straightforward arrangement providing a hood cover member to lay across the opening provided in the hood of a golf bag when the hood is open to provide covering for the opening in the hood, which is easily removed from the opening and returns substantially unassisted to cover the opening after a club has been withdrawn or replaced in the bag.

More particularly, the present invention provides a hood attachment for a golf bag cover including a cap member to be received over the top of the hood, a flap member extending downwardly from the cap member, fastener means carried by the cap member to engage cooperative fastener means a flap member extending from the cap member to cover an opening in the hood, carried by the hood member, fastener means carried adjacent the bottom portion of the flap member to engage cooperative fastener means carried by the hood member, when the flap member is used to cover the opening provided in the hood member. A second fastener means can be provided adjacent the bottom edge of the flap member to engage a second cooperative fastener means carried by the hood member.

BRIEF DESCRIPTION OF THE DRAWINGS

Referring now to FIG. 1 of the drawings which shows a typical golf bag 1 having a hood 2 providing an opening 3 where a zipper 13 is provided to close the opening. Cover 4, in accordance with the present invention, as described hereinafter, can be adapted to be received by hood 2.

Figure 1:
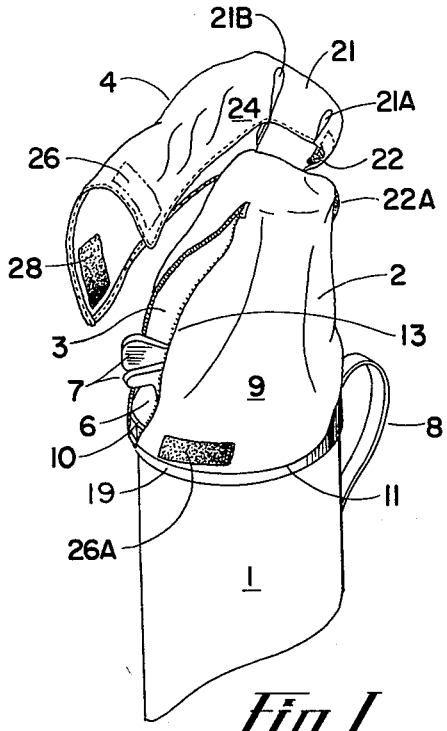
FIG. 1 shows a golf bag, with hood, and one example of a cover in accordance with the present invention.

The bag shown in FIG. 1 is of relatively conventional construction, and comprises an open end container formed of canvas, leather, or other appropriate material and includes an opening 6 to receive assorted golf clubs 7. A strap 8 is provided for suspending the bag from the shoulder of the player or the player's caddy.

The upper end of the golf bag 1 may, as is conventional, provide a re-enforcing cuff 19 which is stitched or otherwise secured to the wall of the bag. The exposed lip 10 surrounding opening 6 may be reinforced with a selected material and where desired, with wire.

Hood 2 is designed to fit over the upper portion of the bag to cover opening 6 and can be fabricated from some moisture resistant material such as canvas, leather, or plastic materials. The hood is configured similarily to an inverted paper bag and includes sidewalls 9 which can be substantially continuous in contour, and includes a lower lip 11 adapted to be secured to the bag, by snaps or other appropriate means. A fastener, for example a zipper 13, can extend from a lower margin of the hood substantially to the apex of the hood so that the hood can be opened when in an extended position to provide access to the interior of bag 1 to allow access to the clubs in the bag and to facilitate closing the bag when the bag is not in use.

Figure 2:
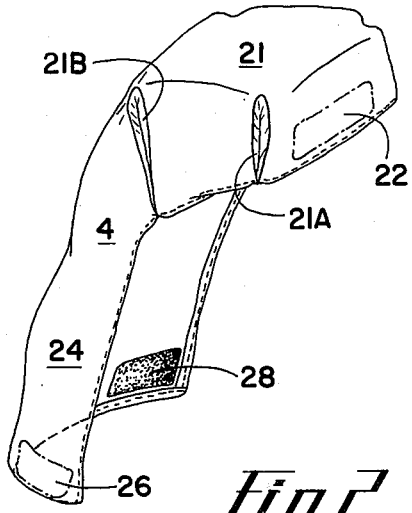
FIG. 2 is a perspective view of a cover in accordance with the present invention.

The hood cover 10 provided by the present invention, as shown in FIG. 2 includes a cap 21 contoured to be received over the top of hood 2 where a fastener 22, for example a Vel-Cro (TN Velcro Mfg. Co.) strip is provided and on the inside top of cap 21 and is disposed to engage a cooperative fastener, for example a mating Vel-Cro strip **22*a* located on top of hood 2 opposite the side including opening 6. Cover cap 21 can be provided with gussets 21*a* to form the cap to fit over the top of hood 2 and a flap 24 is provided to be carried by cap 22 to extend downwardly from cap 22 to cover opening 6 provided in hood 2**.

In accordance with another feature of the present invention, a fastener means for example a Vel-Cro strip 26 can be provided on an inside of flap 24 adjacent the bottom edge thereof and a cooperative fastener, for example a cooperative mating strip **26*a* can be provided on hood 2 or on bag 1 so that one side of flap 24 can be secured to the hood of the bag. A second fastener for example a Vel-Cro strip 28 can be provided at the opposite side of flap 24 to be secured to a second cooperative Vel-Cro strip carried by hood 2**. (not shown).

Figure 3:
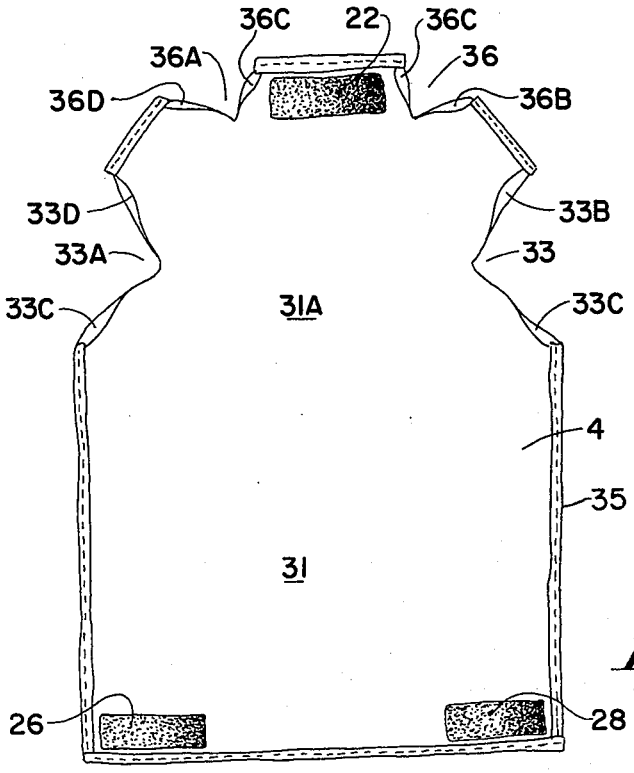
FIG. 3 is a pattern for a cover arrangement in accordance with the present invention.

In accordance with one feature of the present invention the hood cover 4 provided by the present invention can be fabricated from one piece of selected material, for example leather, plastic or cloth, to have a configuration as shown in FIG. 3.

Referring now to FIG. 3, the material is cut as shown and includes a generally rectangular segment 31, which is surrmounted by a generally semi-circular section **31*a* configured to provide hood cap member 21. Generally opposed triangular segments 33 and 33*a* are removed from opposite sides of the section 32 adjacent segment 31 and smaller triangular segments 36 and 36*a* are removed from opposite sides of the upper portion of segment 32 to provide cooperative dart means for formation of gussetts 21*a* and 21*b***. Opposite sides of the triangular members are fastened together, for example by sewing or gluing.

The fastener means 22, and 26, and 28 can be secured to the edges of segment 32 as shown in FIG. 3.

A hem 35 can be provided surrounding the material. To assemble and form the hood provided by the present invention, edges 33*b* and 33*c* of dart 33 are fastened together on one side of element 31*a*, while sides 33*d* and 33*c* are on the opposite side of element 33*a* are fastened, for example by sewing or gluing to form dart 21*c*. Likewise edges 36*b* and 36*c* of dart 36 are fastened together and edges 36*d* and 36*c* of dart 36*a* are fastened together to form darts 21*c*.

The hood, when fully assembled as previously described, can be folded flat and stored in cooperative purches normally found on the outside of golf bags. The hood can be used when desired by securing fastener 26 of cap 21 to the cooperative fastener 22*a* at the top of hood 2. In this position flap 24 falls over opening 3 of hood 2. When access to bag is desired flap 24 is moved to the side or is lifted to permit clubs to be withdrawn or replaced through opening 3. Flap 24 then falls back into place to cover opening 3 to protect the clubs in place in bag 1.

The fasteners to be attached are carried by the bag or hood to receive fasteners 26 and 28 of cover 4 can be secured to hood 2. When the bag is in use one of the fasteners 26 and 28 can be secured to the bag to prevent flap 24 of cover 10 from falling away from hood 2. In some cases, it is desirable to secure both fasteners 26, and 28 to the hood or bag, for example when the bag 1 is to be carried for a long distance.

It will be recognized that the foregoing is but one example of an arrangement in accordance with the present invention and that various modifications within the scope of the present invention will occur to those skilled in the art upon reading the disclosure set forth hereinbefore.

The invention claimed is:

1. An arrangement comprised of a golf bag cover means in combination with golf bag hood means wherein said hood means is secured to a golf bag around the club receiving opening of said golf bag to protect golf clubs retained in said golf bag, and said hood means extends outwardly from said opening of said golf bag and has longitudinally extending hood opening means to allow access to said golf clubs, and said hood cover means includes: cap means releasably secured to the top of said hood means in spaced relation from said hood means opening; and flexible flap means of selected width extending from said cap means and completely covering said hood opening means.

2. The invention of claim 1 where said flap means includes releasable fastener means adjacent the end of said flap means opposite said cap means to be releasably secured to cooperative fastener means carried by said hood means.

3. The invention of claim 1 wherein said hood cover menas is formed from a selected flat, flexible cloth like material having a generally semi-circular element surrmounted on a generally rectangular element which provides said flap means wherein said semi-circular element includes selectively spaced dart means cut into the periphery of said semi-circular element wherein opposite sides of each said dart means are secured together to form said cap means.

* * * * *